US008490555B1

(12) United States Patent
Agee

(10) Patent No.: US 8,490,555 B1
(45) **Date of Patent: *Jul. 23, 2013**

(54) HEIGHT ADJUSTABLE TABLE

(75) Inventor: Michael Agee, Pineville, LA (US)

(73) Assignee: Baker Manufacturing Company, Inc., Pineville, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/603,003

(22) Filed: Sep. 4, 2012

Related U.S. Application Data

(63) Continuation of application No. 13/053,942, filed on Mar. 22, 2011, now Pat. No. 8,256,359, which is a continuation of application No. 11/669,672, filed on Jan. 31, 2007, now Pat. No. 7,908,981.

(51) Int. Cl.
*A47B 9/00* (2006.01)

(52) U.S. Cl.
USPC ..... 108/147; 248/188.2

(58) Field of Classification Search
USPC ..... 108/147.11, 147.19, 147, 144; 248/188.1, 248/188.2, 188.4, 188.5
See application file for complete search history.

(56) References Cited

U.S. PATENT DOCUMENTS

| | | | |
|---|---|---|---|
| 3,080,835 | A | 3/1963 | Guglielmi |
| 3,606,450 | A | 9/1971 | Sedgwick |
| 3,820,176 | A | 6/1974 | Feiertag |
| 4,139,175 | A | 2/1979 | Bauer |
| 4,515,087 | A | 5/1985 | Kurrasch |
| 4,570,547 | A | 2/1986 | Colby |
| 4,615,279 | A | 10/1986 | de la Haye |
| 4,714,028 | A | 12/1987 | Uredat-Neuhoff |
| 5,495,811 | A | 3/1996 | Carson et al. |
| 5,562,052 | A | 10/1996 | Glashouwer et al. |
| 5,669,312 | A | 9/1997 | Norton |
| 5,845,590 | A | 12/1998 | Seidl |
| 5,890,438 | A | 4/1999 | Frankish |
| 6,131,870 | A | 10/2000 | Tseng |
| 6,148,741 | A | 11/2000 | Motta |
| 6,182,583 | B1 | 2/2001 | Larson |
| 6,224,155 | B1 | 5/2001 | DeKranker et al. |
| 6,289,825 | B1 | 9/2001 | Long |
| 6,435,112 | B1 | 8/2002 | Insalaco |
| 6,474,246 | B2 | 11/2002 | Hsu |
| 6,494,005 | B2 | 12/2002 | Zimmerman |
| 6,510,803 | B1 | 1/2003 | Agee |
| 6,546,880 | B2 | 4/2003 | Agee |
| 6,550,728 | B1 | 4/2003 | Fuhrman |
| 6,598,841 | B2 | 7/2003 | Erickson et al. |
| 6,935,250 | B1 | 8/2005 | Arnold |
| 7,077,068 | B1 | 7/2006 | Agee |
| 7,908,981 | B2 | 3/2011 | Agee |
| 8,256,359 | B1 | 9/2012 | Agee |

*Primary Examiner* — Jose V Chen
(74) *Attorney, Agent, or Firm* — Garvey, Smith, Nehrbass & North, LLC.; Charles C. Garvey, Jr.; Vanessa M. D'Souza

(57) ABSTRACT

A height adjustable table is disclosed wherein all horizontal supports that span between legs have been eliminated to increase storage space and knee space in the area under the table work surface. A unique telescoping leg arrangement is disclosed.

19 Claims, 9 Drawing Sheets

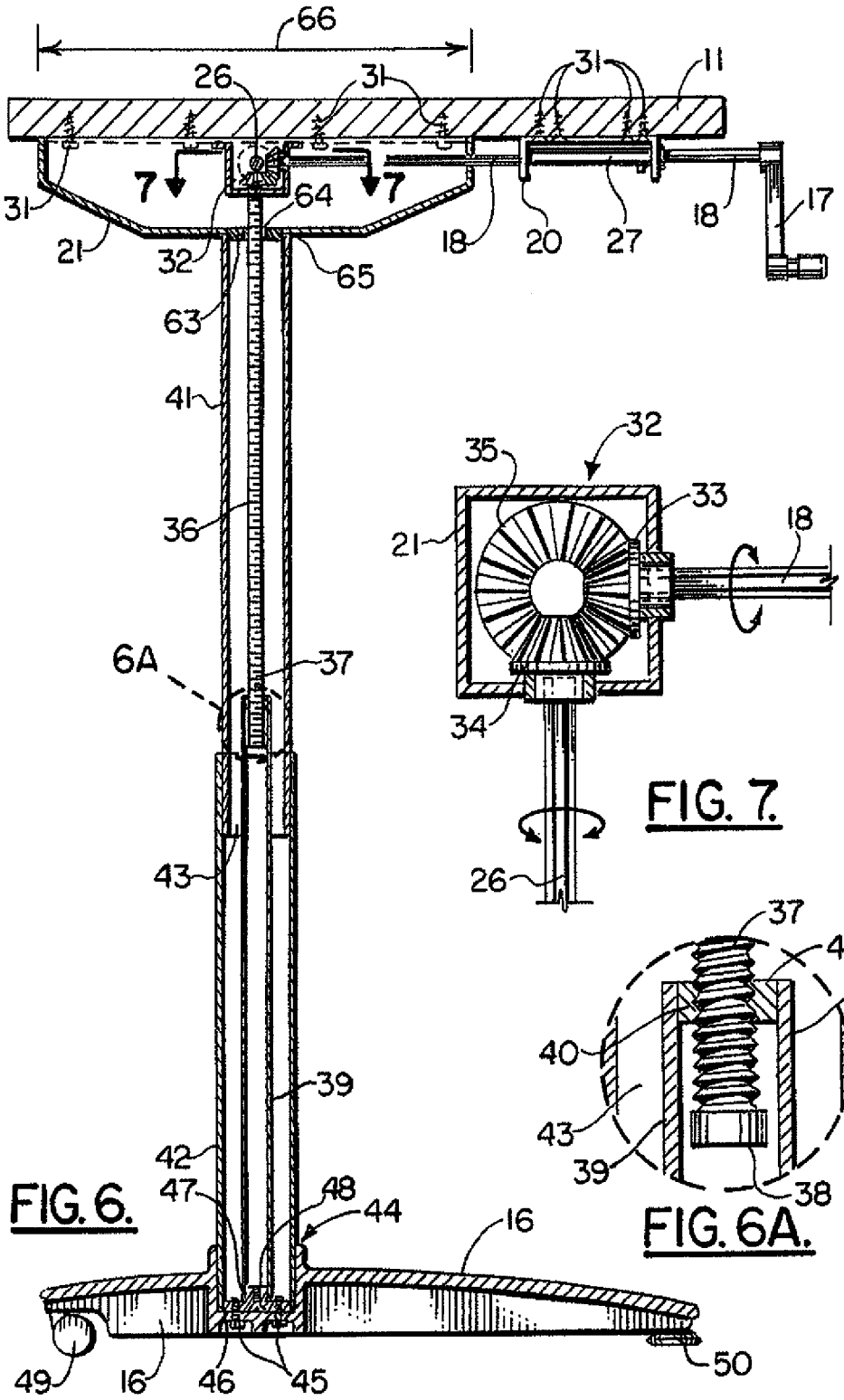
FIG. 6.
FIG. 7.
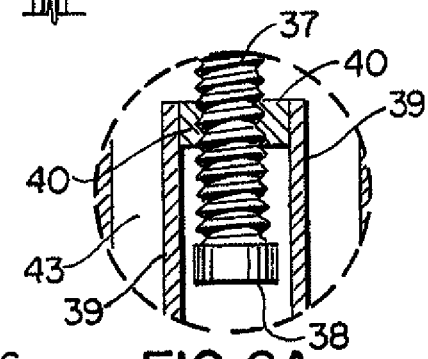
FIG. 6A.

HEIGHT ADJUSTABLE TABLE

CROSS-REFERENCE TO RELATED APPLICATIONS

This is a continuation of U.S. patent application Ser. No. 13/053,942, filed Mar. 22, 2011 (issued as U.S. Pat. No. 8,256,359 on 4 Sep. 2012), which is a continuation of U.S. patent application Ser. No. 11/669,672, filed Jan. 31, 2007 (issued as U.S. Pat. No. 7,908,981 on Mar. 22, 2011), each of which is incorporated herein by reference and priority of each is claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to height adjustable tables. More particularly, the present invention relates to an improved height adjustable table that includes specially configured telescoping legs that enable the table to be supported without the use of any obstructive supports that are typically placed in an intermediate position between a supported table top and a floor or other underlying support surface. Further, the present invention provides an improved telescoping leg arrangement that enables manual and/or motorized operation of the telescoping legs.

2. General Background of the Invention

Height adjustable tables enable different users to comfortably use the table notwithstanding differences in height. Additionally, height adjustable tables enable a user to vary the elevation of the table depending upon the activity being conducted. For example, a user might choose a first elevation of a table top when operating a computer. That person might set the table at a different height or elevation when reading a book.

Some height adjustables have been patented. The following table lists patents that have issued and that relate to height adjustable tables.

TABLE

| Pat. No. | TITLE | ISSUE DATE |
|---|---|---|
| 4,515,087 | Height Adjustable Table | May 7, 1985 |
| 4,570,547 | Table With Adjustable Height Mechanism | Feb. 18, 1986 |
| 4,714,028 | Height Adjustable Table | Dec. 22, 1987 |
| 5,495,811 | Height Adjustable Table | Mar. 05, 1996 |
| 5,562,052 | Height Adjustable Table | Oct. 08, 1996 |
| 6,435,112 | Height Adjustable Table | Aug. 20, 2002 |
| 6,510,803 | Height Adjustable Table | Jan. 28, 2003 |
| 6,546,880 | Height Adjustable Table | Apr. 15, 2003 |
| 6,550,728 | Height Adjustable Table | Apr. 22, 2003 |
| 6,598,841 | Height Adjustable Table Leg | Jul. 29, 2003 |
| 6,935,250 | Adjustable Height Table With Multiple Legs Operable By a Single Crank | Aug. 30, 2005 |
| 7,077,068 | Height Adjustable Table | Jul. 18, 2006 |
| 8,256,359 | Height Adjustable Table | Sep. 4, 2012 |

The problem with most height adjustable tables is that they employ a horizontally extending beam or brace that spans between table legs at an intermediate position in between the table top and an underlying support surface (e.g. floor). This intermediate support prevents storage of large items (e.g. computers) under the desk. It also limits space available for a user's knees.

BRIEF SUMMARY OF THE INVENTION

The present invention provides an improved height adjustable table that eliminates the need for bracing at an intermediate position that is generally in between the table top of the height adjustable table and an underlying support surface such as the present invention provides an elevating table apparatus that includes a table top that provides an upper work surface and a lower surface.

A plurality of table legs include at least one pair of telescoping members including an inner member and a first outer sleeve member that has a bore that is receptive of the inner member.

The second outer sleeve member envelops the lower end of at least one of the table legs.

There are no connections that span in a generally horizontal direction or in a diagonal direction from one leg to another at a position below the table top.

The second outer sleeve does not prevent telescoping movement of the table legs. The second outer sleeve is a static member that remains at a lowermost position on the table leg.

A structural housing forms an interface between the upper end of each leg and the table top. Within this structural housing, a geared mechanism can be provided that enables a user to elevate the table top relative to an underlying support surface or floor.

At least one of the legs is supported by a lower foot that extends in front of and behind the leg.

The present invention includes an elevating table apparatus comprising a table top providing an upper work surface and a lower surface; a plurality of table legs, each leg including a pair of telescoping members including an inner member and a first outer sleeve member that has a bore that is receptive of the inner member; a second outer sleeve member that envelops the lower end of at least one of the table legs; wherein there are no connections that span in a generally horizontal direction from one leg to another leg other below said table top; wherein the second outer sleeve does not prevent telescoping movement of the table legs; a geared mechanism on each leg that enables a user to elevate the table top relative to an underlying support surface or floor; and a gear box housing that envelops the geared mechanism and that is structurally connected to both the table top and each leg; the gear box housing being connected to the leg below the geared mechanism; the gear box housing having an upper peripheral edge portion that is structurally connected to the table top and that extends radially out from the gear mechanism, and wherein the gear box housing surrounds the geared mechanism.

Preferably, the gear mechanisms are manually movable using a crank.

Preferably, at least one of the legs is supported by a lower foot that extends in front of and behind the leg.

Preferably, the inner member moves up and down relative to the first outer sleeve member.

Preferably, the first outer sleeve member moves up and down relative to the inner member.

Preferably, the present invention further comprises a caster fitted to the bottom of at least one of the legs.

Preferably, the lower foot has a socket that is receptive of the lower end of the leg and the lower end of the second outer sleeve member.

Preferably, each leg and foot are rotatable so that feet on multiple legs can be oriented to form an acute angle.

Preferably, the inner member and outer sleeves are generally cylindrically shaped.

The present invention includes an elevating table apparatus comprising a table top providing an upper work surface and a lower surface; a plurality of table legs, each leg including a pair of telescoping members including an inner member and a first outer sleeve member that has a bore that is receptive of the inner member, and wherein each leg has a minimum leg height and a maximum leg height; a second outer sleeve member that envelops the lower end of at least one of the table legs; wherein there are no connections that span in a generally horizontal direction from one leg to another leg other below said table top; and wherein the second outer sleeve does not prevent telescoping movement of the table legs, wherein said second outer sleeve has a height about equal to the minimum leg height.

The present invention includes an elevating table apparatus comprising a table top providing an upper work surface and a lower surface; a plurality of table legs, each leg including a pair of telescoping members including an inner member and a first outer sleeve member that has a bore that is receptive of the inner member; a second outer sleeve member that envelops the lower end of at least one of the table legs; wherein there are no connections that span in a generally horizontal direction from one leg to another leg other below said table top; wherein the second outer sleeve does not prevent telescoping movement of the table legs; a geared mechanism on each leg that enables a user to elevate the table top relative to an underlying support surface or floor; a gear box housing that envelops the geared mechanism and that is structurally connected to both the table top and each leg; and the gear mechanisms being simultaneously rotated during elevation and wherein load transfer between the table top and legs is via a said gear box housing.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 6 is a sectional elevation view of a preferred embodiment of the apparatus of the present invention;

FIG. 6A is a fragmentary view of a preferred embodiment of the apparatus of the present invention;

FIG. 7 is a sectional view taken along lines 7-7 of FIG. 6;

DETAILED DESCRIPTION OF THE INVENTION

Figure 1:
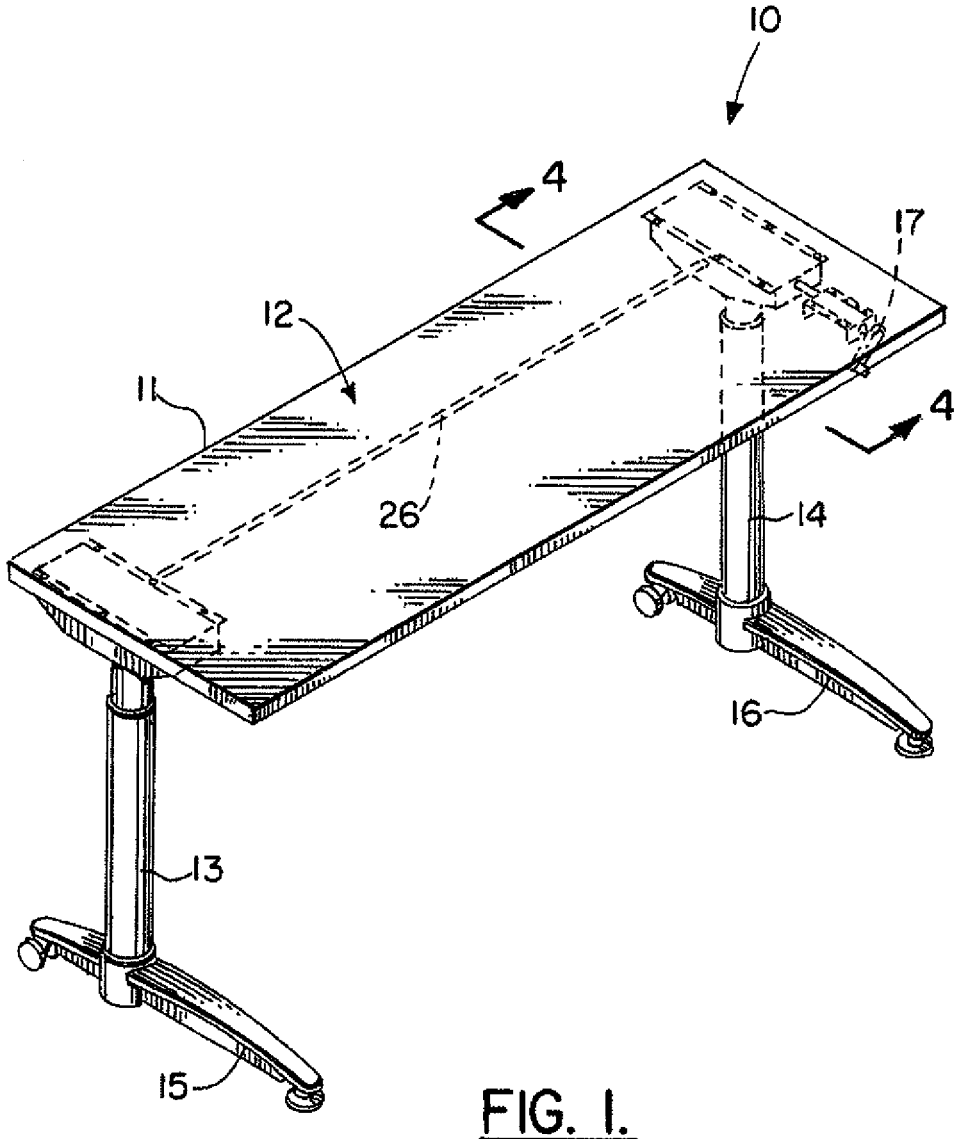
FIG. 1 is a perspective view of a preferred embodiment of the apparatus of the present invention.

FIGS. 1-13 show a preferred embodiment of the apparatus of the present invention, designated generally by the numeral 10. Height adjustable table 10 provides an expansive top 11 having a work surface 12. Top 11 can be supported with a pair of spaced apart legs 13, 14. Each leg 13, 14 is joined to a foot. The leg 13 connects to foot 15. The leg 14 connects to foot 16.

Table 10 can be height adjusted using crank 17. Crank 17 is joined to a crank rod 18 that can be rotated as illustrated by arrow 19 in the drawings. The rod 18 is supported using rod support 20. Rod 18 also extends to a structural gear box housing 21 as shown in FIGS. 1 and 7.

Figure 2:
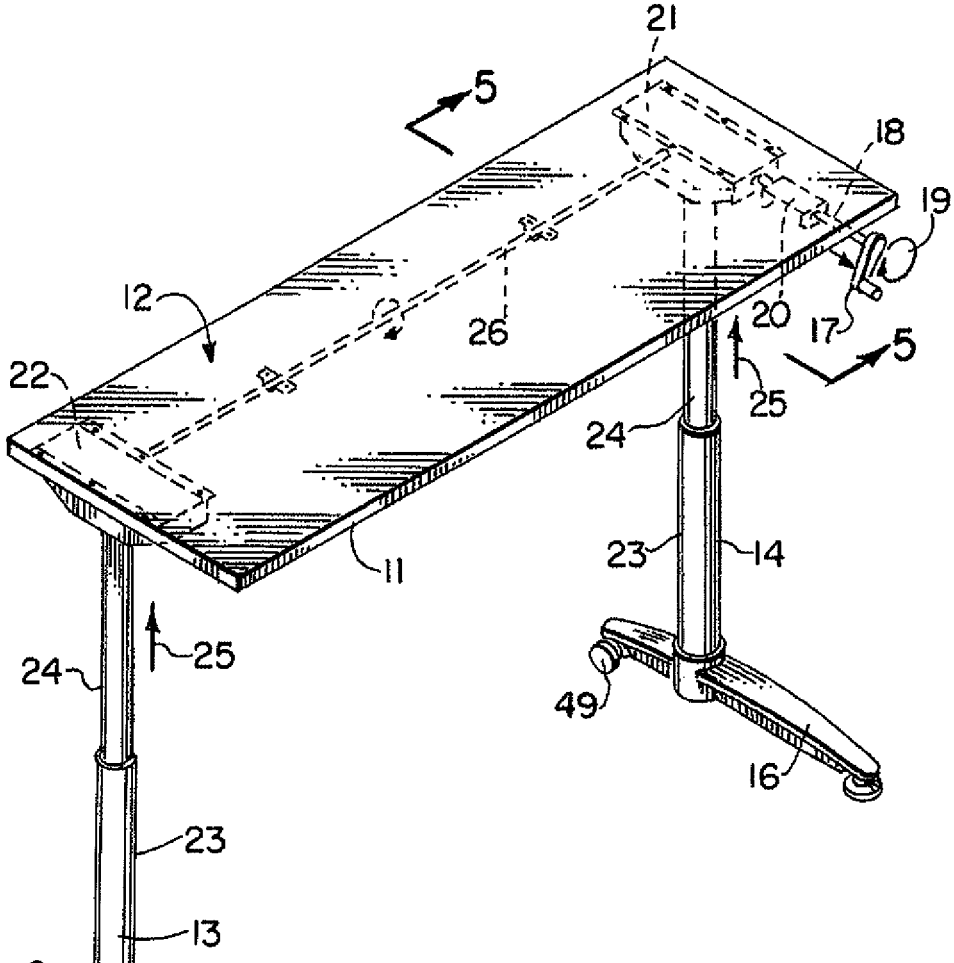
FIG. 2 is another perspective view of a preferred embodiment of the apparatus of the present invention showing the table in an elevated position.

Each leg 13 has a lower section 23 and an upper section 24. The upper section 24 moves up and down relative to lower section 23 as illustrated by arrow 25 in FIG. 2. FIG. 1 illustrates a collapsed lowermost position of upper section 24. FIG. 2 illustrates an upper elevated position of upper section 24.

Rod 26 extends between gear box housings 21, 22. The gear box housing 21 is associated with leg 14. The gear box housing 22 is associated with leg 13. Each of the gear box housings 21, 22 provides a gear box arrangement as shown in FIGS. 6 and 7. Each gear box housing 21, 22 includes a gear cluster 32. The gear cluster 32 includes a bevel gear 35 mounted at the upper end portion of externally threaded shaft 36. The gear cluster 32 also includes a bevel gear 33 mounted upon an end of crank rod 18. For the gear box housing 22, it should be understood that there would not be a rod 18 nor bevel gear 33. Instead, the gear box housing 22 would contain an externally threaded shaft 36 having bevel gear 35 and a bevel gear 34 mounted to an end portion of rod 26 that enters gear box housing 22.

Figure 3:
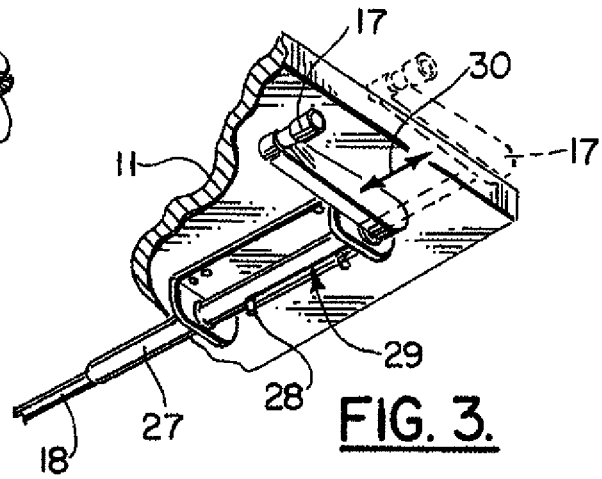
FIG. 3 is a fragmentary view of a preferred embodiment of the apparatus of the present invention.
Figure 5:
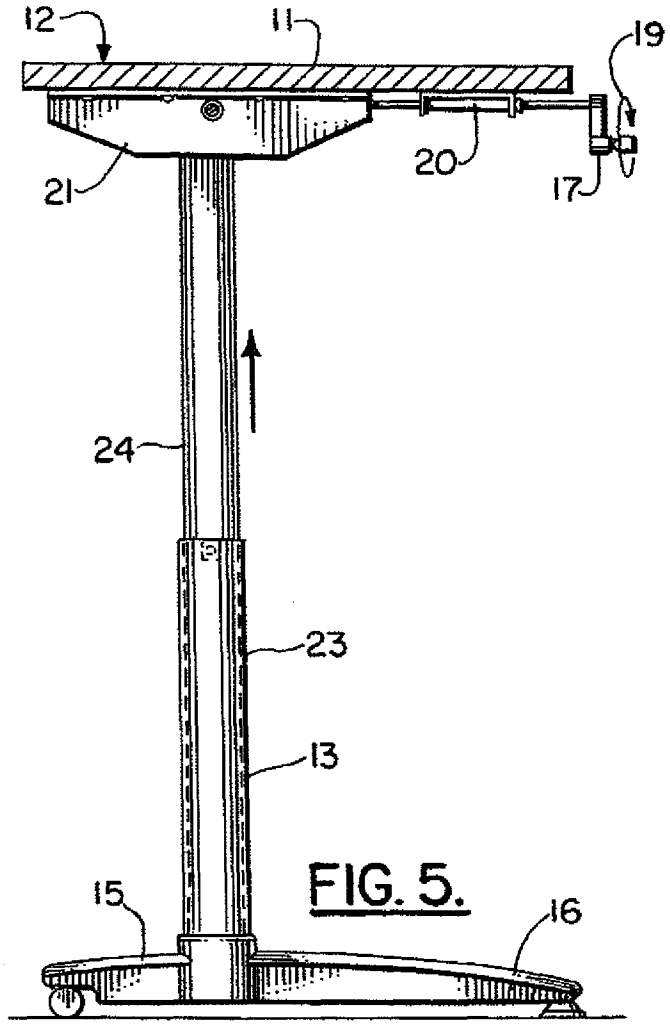
FIG. 5 is a side sectional elevation view of a preferred embodiment of the apparatus of the present invention, taken along lines 5-5 of FIG. 2.
Figure 4:
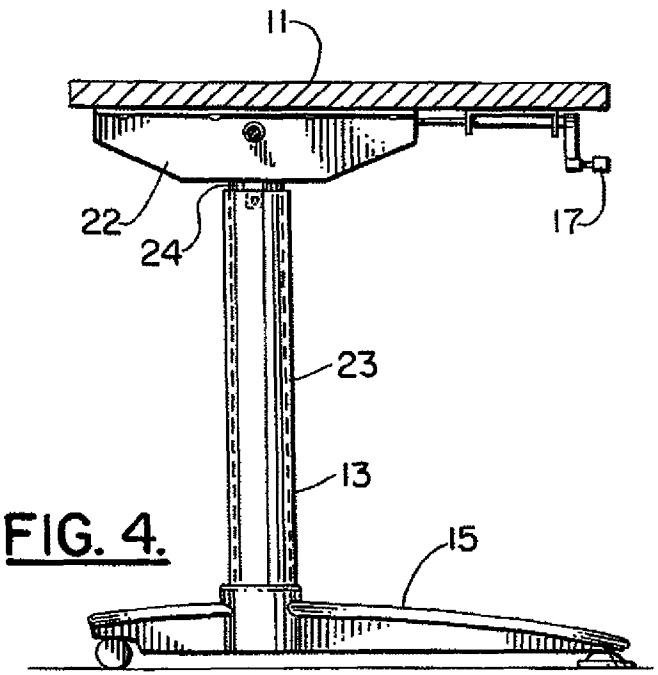
FIG. 4 is a side, sectional view of an alternative embodiment of the apparatus of the present invention, taken along lines 4-4 of FIG. 1.
Figure 8:
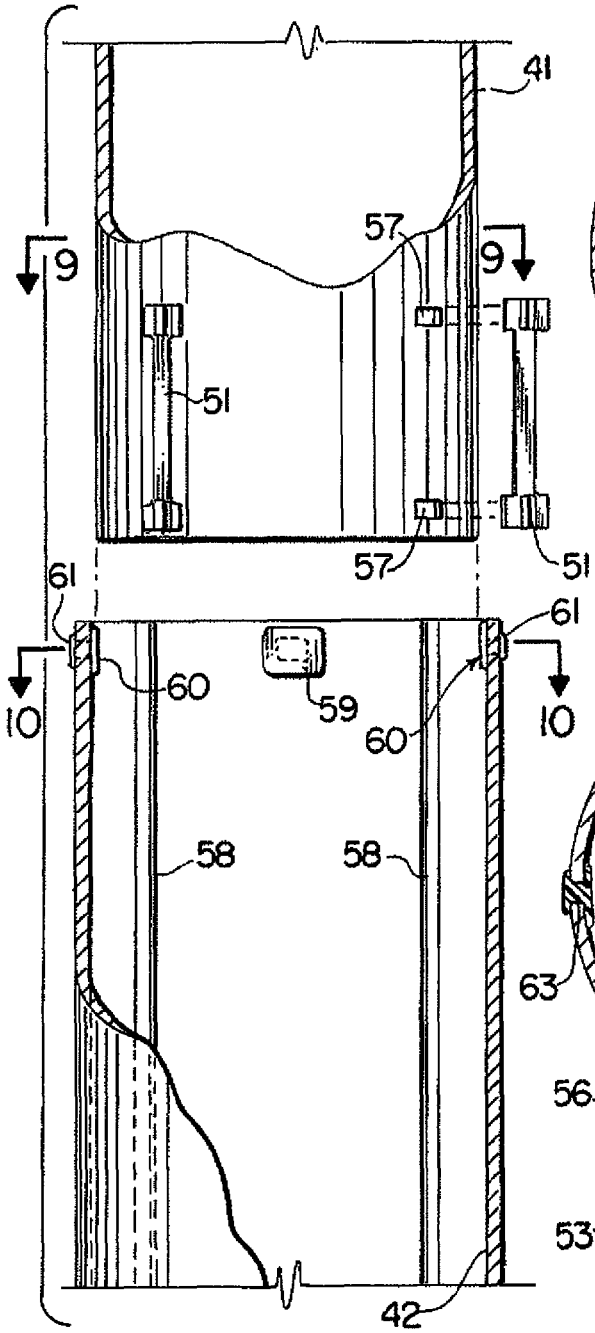
FIG. 8 is an enlarged sectional view of a preferred embodiment of the apparatus of the present invention.
Figure 9:
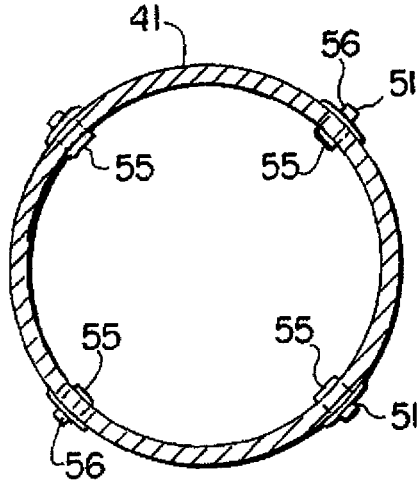
FIG. 9 is a sectional view taken along lines 9-9 of FIG. 8.

In FIG. 6, crank rod 18 can provide a rod telescoping section 27. The rod telescoping section 27 can include a stop pin 28 that travels in slot 29, as shown in FIG. 3. In this fashion, the crank 17 can be moved from a retracted position as shown in hard lines in FIG. 3 to a operating position as shown in phantom lines in FIG. 3 and in hard lines in FIGS. 2 and 6. Arrow 30 in FIG. 3 illustrates movement of crank 17 between retracted and extended, operating positions. In FIG. 6, fasteners 31 can be used to secure gear box housing 21 and rod support 20 to the underside of expansive top 11. Similarly, fasteners 31 can be used to secure gear box housing 22 to the underside of expansive top 11.

In FIGS. 6 and 6A, externally threaded shaft 36 has a lower end portion 37 that is fitted with stop 38. Internally threaded sleeve 39 provides an internally threaded nut 40 that engages externally threaded shaft 36 as shown in FIG. 6A. When stop 38 engages internally threaded nut 40, maximum elevation of expansive top 11 is reached. Upper leg section 24 provides an upper tube 41. Lower leg section 23 provides a lower tube 42. A support sleeve 43 can be placed in between the lower end portion of the upper tube 41 and upper end portion of the internally threaded sleeve 39 (see FIG. 6). The sleeve 39 can be a square tube, for example.

A foot 16 provides socket 44 that is receptive of lower tube 42 as shown in FIG. 6. Fasteners 45 form a connection between foot 16 and plate 46. Plate 46 can be fastened to the lower end portion of tube 42 using welding, for example. A lower threaded nut 47 is embedded within the lower end portion of tube 39. Fastener 48 centers tube 39 upon plate 46 and thus centers tube 39 with respect to tube 42 as shown in FIG. 6. Foot 15 or 16 can provide one or more casters 49 or fixed supports 50, or one of each. In FIG. 6, a structurally robust connection is made between upper tube 41 and gear box housing 21. Each gear box housing 21, 22 is generally bowl shaped, extending in front of and behind as well as on both sided of the gear box that is envelops. A peripheral edge of each housing is joined to the table top along a circumferentially spaced, radially spaced position relative to a leg and gearbox that it surrounds and envelops. A circular plate 63 provides an opening 64 through which externally threaded shaft 36 can pass. A connection 65 between tube 41 and gear box housing 21 can be for example a welded connection that includes welding to circular plate 63. This connection enhances the moment load transfer capability between upper tube 41 to expansive top 11 over an elongated area designated by the dimension arrow 66 in FIG. 6. This arrangement thus eliminates the need for intermediate bracing which is typically found in the prior art, and that interferes with the knees of a user and/or with the storage of large items in the area under the table top 11, such as computers.

Figure 10:
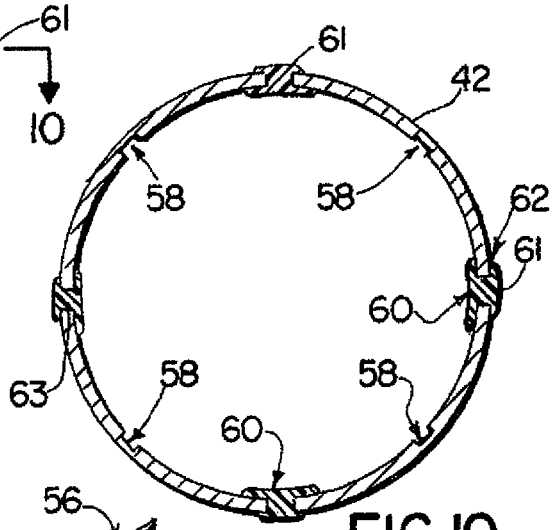
FIG. 10 is a sectional view taken along lines 10-10 of FIG. 8.
Figure 11:
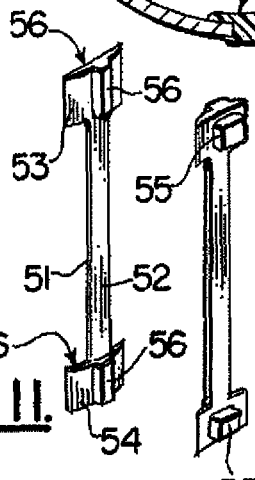
FIG. 11 is a partial perspective view of a preferred embodiment of the apparatus of the present invention.
Figure 12:
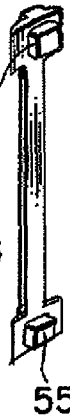
FIG. 12 is a partial perspective view of a preferred embodiment of the apparatus of the present invention.
Figure 13:
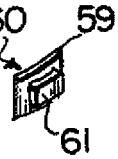
FIG. 13 is a partial perspective view of a preferred embodiment of the apparatus of the present invention.

FIGS. 8-13 show a guiding arrangement that interfaces upper tube 41 and lower tube 42. Guides 51 are placed at circumferentially spaced apart positions on upper tube 41 as shown in FIG. 10. In FIGS. 11 and 12, each guide 51 has an elongated center section 52, and enlarged upper section 53 and an enlarged lower section 54. Each enlarged section 53, 54 provides a lug 55. The lugs 55 enable each guide 51 to be mounted to sockets or openings in upper tube 41.

Rib 56 is provided in each enlarged section 53, 54 opposite lug 55 as shown in FIGS. 11 and 12. The ribs 56 travel in channels 58 formed on the inside surface of lower tube 42.

Slides 59 are mounted in openings 62 in lower tube 42. Each slide 59 has an inner concave surface 60. Each slide 59 provides a lug 61 for attaching to socket or opening 62 in lower tube 42.

Figure 14:
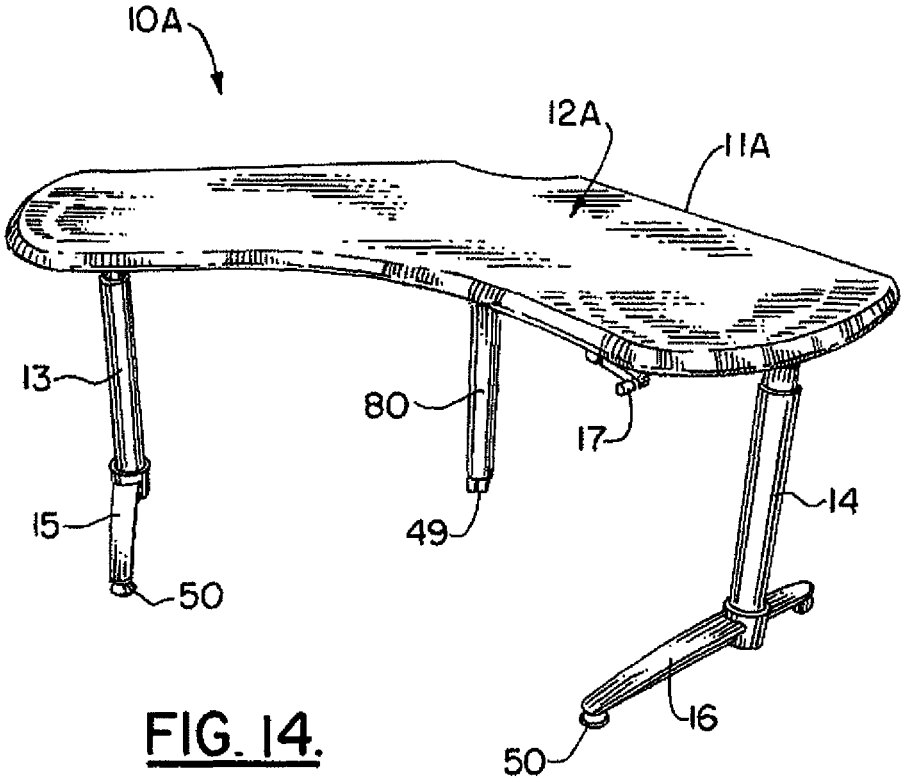
FIG. 14 is a perspective view of a second embodiment of the apparatus of the present invention.
Figure 15:
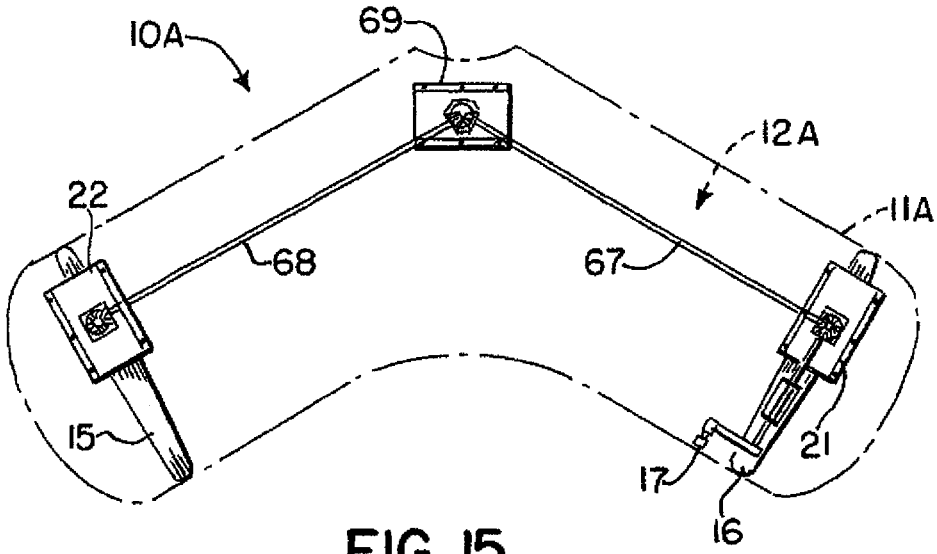
FIG. 15 is a plan view of the second embodiment of the apparatus of the present invention.

FIGS. 14 and 15 show a second embodiment of the apparatus of the present invention, designated generally by the numeral 10A. Height adjustable table 10A is similar to the preferred embodiment of FIGS. 1-13. In FIGS. 14 and 15 however, a curved expansive top 11A is provided having a work surface 12A. Height adjustable table 10A provides three legs 13, 14, 80. Each of the legs 13, 14, 80 can be constructed in accordance with the preferred embodiment of FIGS. 1-13. The leg 80 provides a single wheeled caster 49, while the feet 15, 16 can provide either a caster 49 or a fixed support 50 as shown in FIG. 6.

In FIG. 15, height adjustable table 10A provides three gear box housings 21, 22 and 69. The gear box housings 21, 22 are constructed in accordance with the preferred embodiment of FIGS. 1-13. The gear box 69 forms an interface between two rods 67, 68. This arrangement is similar to that shown in FIG. 7. However, the rods 67, 68 form an obtuse angle as opposed to a ninety degree or right angle. In that regard, each rod 67, 68 provides bevel gears 33 or 34 at each end portion which engage a bevel gear 35 of an externally threaded rod 36.

Figures 16, 17:
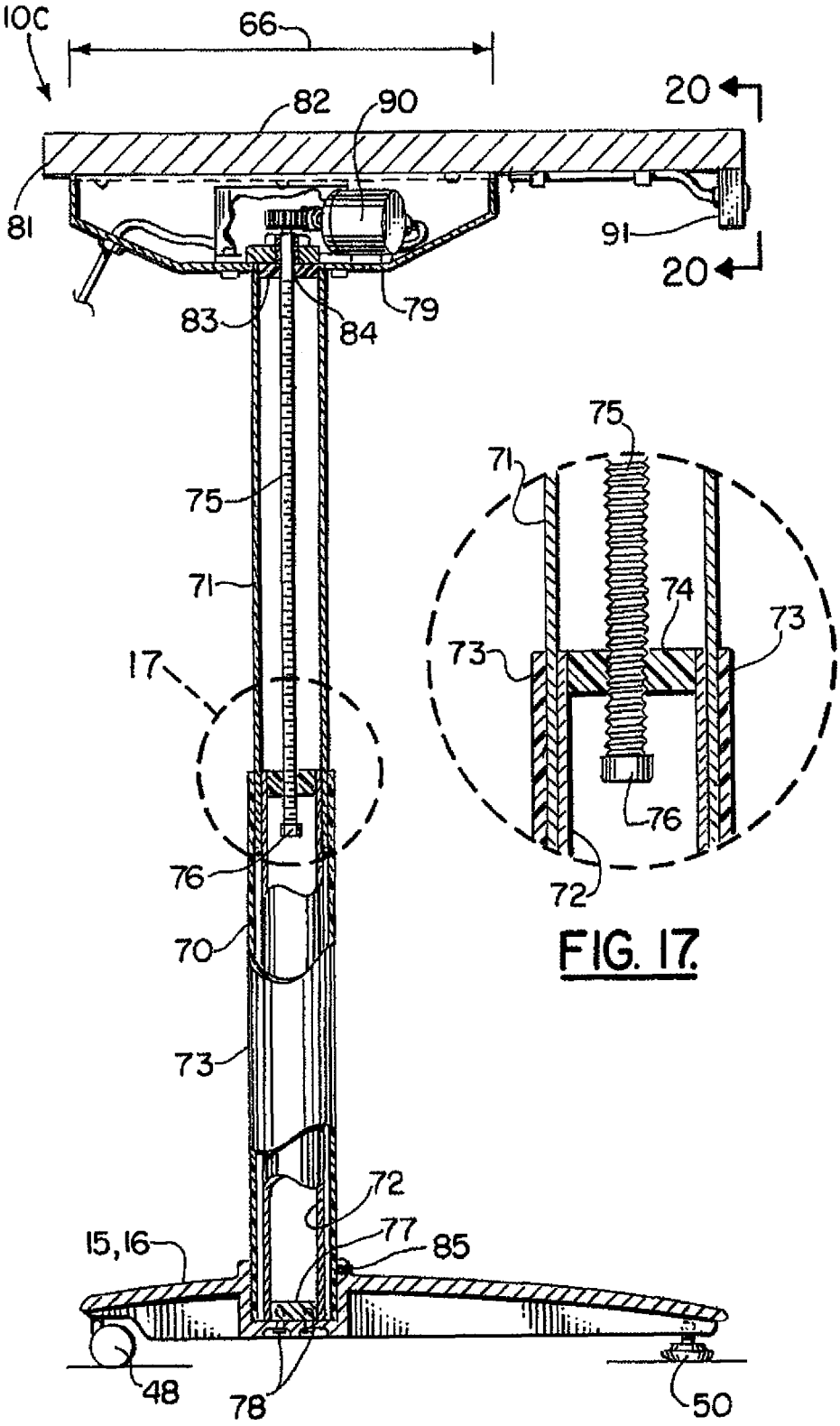
FIG. 16 is a sectional, elevation view of a third embodiment of the apparatus of the present invention.
FIG. 17 is a fragmentary sectional elevation view of the third embodiment of the apparatus of the present invention.
Figure 18:
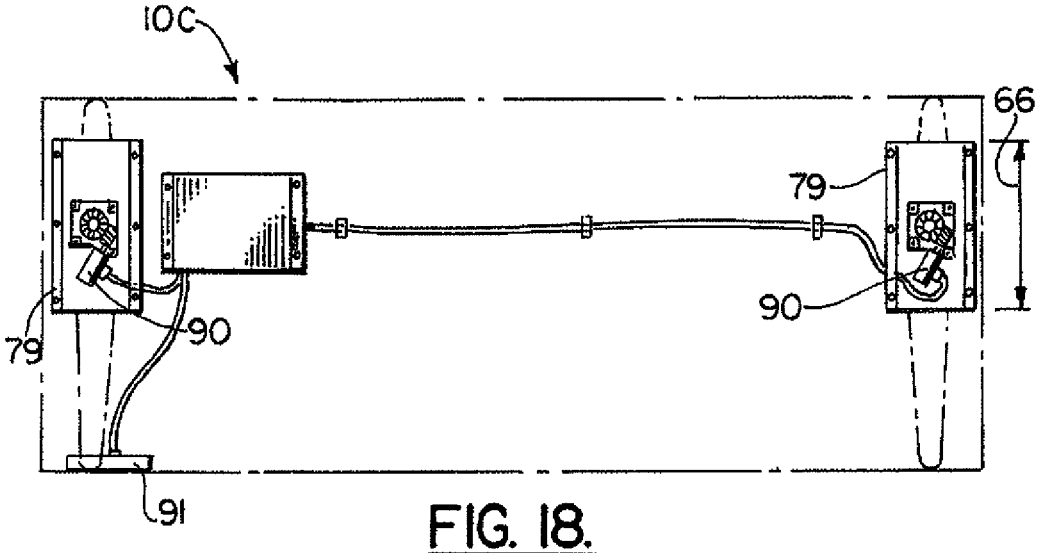
FIG. 18 is a partial plan view of the third embodiment of the apparatus of the present invention.
Figure 22:
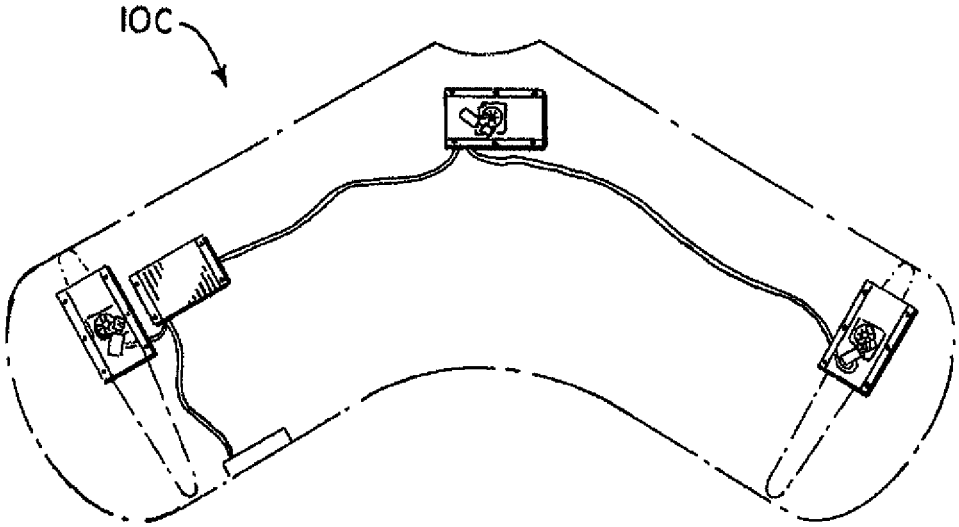
FIG. 22 is a schematic plan view of the third embodiment of the apparatus of the present invention.
Figure 23:
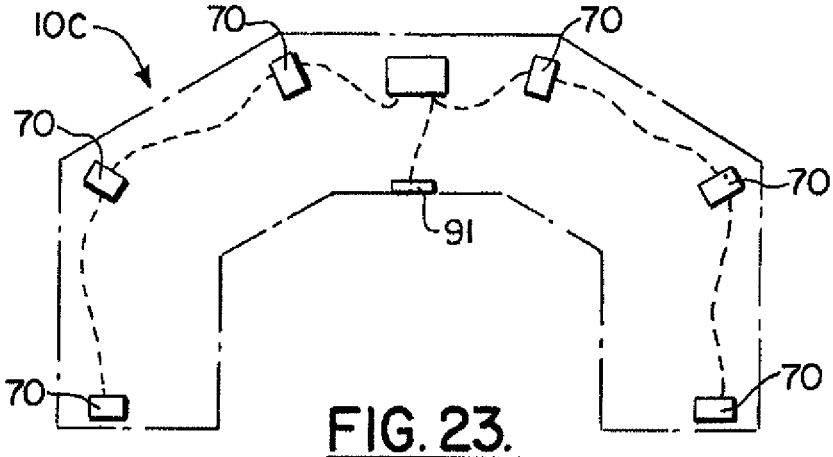
FIG. 23 is a schematic plan view of the third embodiment of the apparatus of the present invention illustrating multiple leg positions.

FIGS. 16-19 and 22-23 show a third embodiment of the apparatus of the present invention, designated generally by the numeral 10C. Height adjustable table 10C employs a telescoping leg 70 that can be used for a two-legged table (FIG. 18), a three-legged table (FIG. 22), or a table having more than three legs (FIG. 23). In FIG. 16, telescoping leg 70 includes an upper elevating section 71 and a lower static section 72. A third leg section is an outer tube 73 that is also static and that surrounds the combination of upper elevating section 71 and lower static section 72. This arrangement of the three sections can be seen in FIGS. 16 and 17.

Externally threaded shaft 75 extends from gear box housing 79 downwardly to internally threaded nut 74 which is mounted in the upper end portion of lower static section 72, as shown in FIG. 17. The lower end of externally threaded shaft 75 provides a stop 76. When elevating the table 10C, expansive top 81 and its work surface 82, a maximum elevation is reached when stop 76 contacts internally threaded nut 74.

Leg 70 can be mounted in a foot such as 15 or 16 using a connection similar to that shown in FIG. 6. In FIG. 16, plate 77 is provided at the lower end portion of lower static section 72. Fasteners 78 can extend through openings in foot 15, 16 to connect with plate 77. In that regard, plate 77 can have multiple internally threaded sockets that are receptive of fasteners 78.

Gear box housing 79 preferably extends a distance 66 that is about equal to or greater than one half the depth of expansive top 81, as shown in FIG. 16. As with the preferred embodiment, a robust connection is formed between leg 70 and gear box housing 79. Gear box housing 79 connects to upper elevating section 71 at circular plate 83. Plate 83 has an opening 84 that enables externally threaded shaft 75 to extend through plate 83 and engage motor drive 90, as will be described more fully hereinafter. A welded or like connection can be formed between the three parts that include gear box housing 79, circular plate 73, and upper elevating section 71 of leg 70. As with the preferred embodiment, this connection enables a high moment load transfer between table top 81 and leg 70, eliminating the need for intermediate supports between legs and below the top 81.

The outer tube 73 is a static tube that is connected to a foot 15 or 16 using adhesive, an interference fit, a threaded connection, or other connection such as a friction fit using for example one or more set screws 85 (see FIG. 16). The upper elevating section 71 thus travels in between lower static section 72 and outer tube 73. The outer tube 70 can be provided in a number of different colors so that a user can match table 10C of the present invention to a selected decor.

Figure 19:
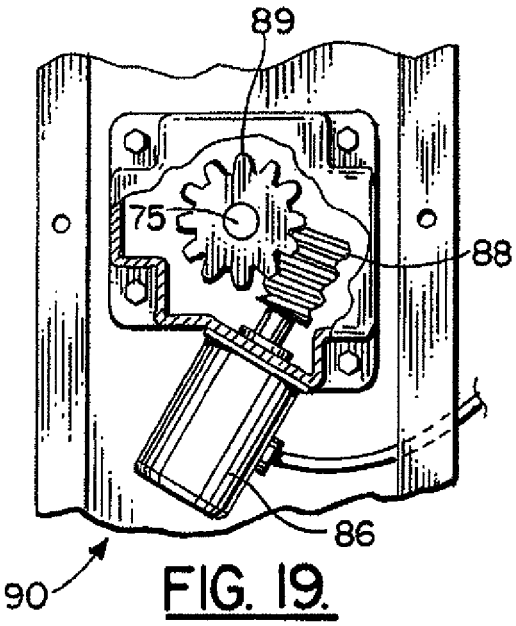
FIG. 19 is a fragmentary view of the third embodiment of the apparatus of the present invention.
Figure 21:
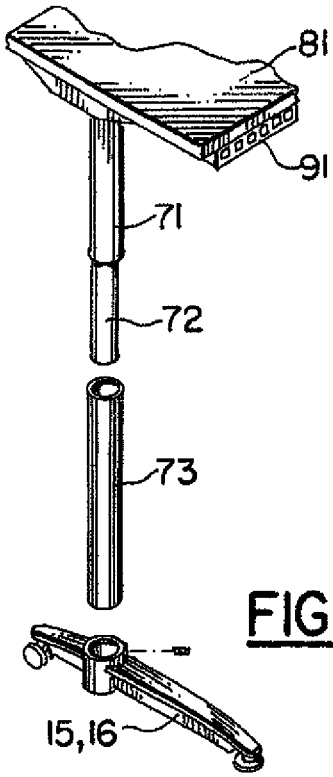
FIG. 21 is a partial perspective exploded view of the third embodiment of the apparatus of the present invention.

In the embodiment of FIGS. 16-19, a motor drive 90 is provided for each gear box housing 79 associated with each leg 70. For the table 10C shown in FIG. 18, there are two legs 70, two gear box housings 79, and two motor drives 90. FIG. 19 illustrates the details of construction of motor drive 90. The motor drive 90 includes an electric motor 86 having a motor shaft 87 fitted with a worm gear 88. Worm gear 88 engages pinion gear 89 that is mounted to the upper end of externally threaded shaft 75. For the embodiment of FIGS. 16-18, each leg 70 has a motor drive 90. Those motor drives 90 are synchronized so that when a user activates operating panel 91, the legs 70 selectively elevate at the same time (using keypad arrow 92) and at the same rate or descend at the same time (using keypad arrow 93) and at the same rate.

Figure 20:
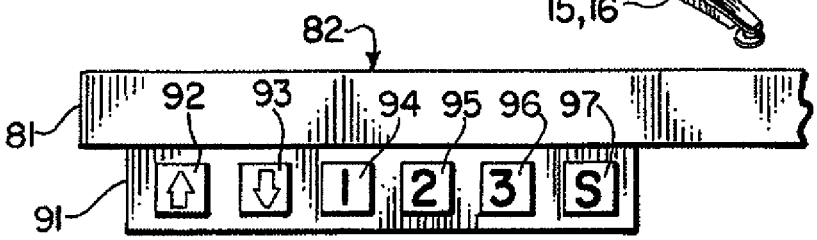
FIG. 20 is a fragmentary view of the third embodiment of the apparatus of the present invention.
Figure 24:
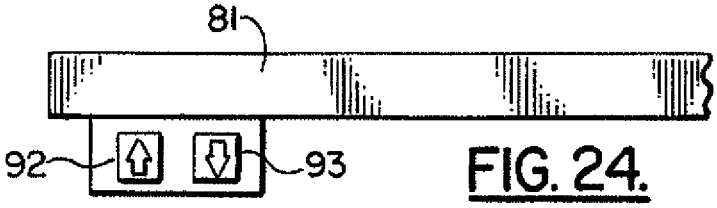
FIGS. 24-25 are schematic views illustrating controllers for controlling operation of the third embodiment of the apparatus of the present invention.
Figure 25:
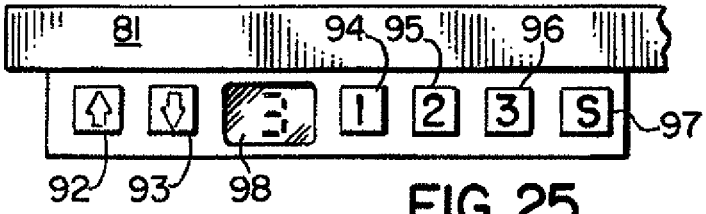

FIGS. 20, 24 and 25 illustrate that different controllers can be used. In FIG. 20, up arrow 92 and down arrow 93 are provided for enabling an operator to elevate or descend expansive top 81. Keypad numerals 94, 95, 96 enable an operator to input a code that "remembers" the position of the table top 81, such as for example when several users are using table 10C at different times. The key number "s", designated by numeral 97 provides a "set" function that identifies a certain code with a certain elevation of a table after a user has input a selected code using the keys 94-96.

FIG. 24 is a simpler arrangement, where only up and down arrows 92, 93 are provided. FIG. 25 is similar to FIG. 20 with the addition of a digital readout 98.

FIGS. 22 and 23 illustrate that multiple legs 70 can be employed, such as three legs 70 of FIG. 22 or even more legs in FIG. 23, in that the motor drives 90 are synchronized.

The following is a list of parts and materials suitable for use in the present invention.

PARTS LIST

| Part Number | Description |
|---|---|
| 10 | height adjustable table |
| 10A | height adjustable table |
| 10B | height adjustable table |
| 10C | height adjustable table |
| 11 | expansive top |
| 11A | expansive top |
| 12 | work surface |
| 12A | work surface |
| 13 | leg |
| 14 | leg |
| 15 | foot |
| 16 | foot |
| 17 | crank |
| 18 | crank rod |
| 19 | arrow |
| 20 | rod support |
| 21 | gear box housing |
| 22 | gear box housing |
| 23 | lower section |
| 24 | upper section |
| 25 | arrow |
| 26 | rod |
| 27 | rod telescoping section |
| 28 | stop pin |
| 29 | slot |
| 30 | arrow |
| 31 | fastener |
| 32 | gear cluster |
| 33 | bevel gear |
| 34 | bevel gear |
| 35 | bevel gear |
| 36 | externally threaded shaft |
| 37 | lower end portion |
| 38 | stop |
| 39 | internally threaded sleeve |

-continued

PARTS LIST

| Part Number | Description |
|---|---|
| 40 | internally threaded nut |
| 41 | upper tube |
| 42 | lower tube |
| 43 | support member |
| 44 | socket |
| 45 | fastener |
| 46 | plate |
| 47 | lower threaded nut |
| 48 | fastener |
| 49 | caster |
| 50 | fixed support |
| 51 | guide |
| 52 | center section |
| 53 | upper section |
| 54 | lower section |
| 55 | lug |
| 56 | rib |
| 57 | socket |
| 58 | channel |
| 59 | slide |
| 60 | concave surface |
| 61 | lug |
| 62 | socket |
| 63 | circular plate |
| 64 | opening |
| 65 | connection |
| 66 | dimension arrow |
| 67 | first rod |
| 68 | second rod |
| 69 | gear box housing |
| 70 | telescoping leg |
| 71 | upper elevating section |
| 72 | lower static section |
| 73 | outer tube |
| 74 | internally threaded nut |
| 75 | externally threaded shaft |
| 76 | stop |
| 77 | plate |
| 78 | fastener |
| 79 | gear box housing |
| 80 | leg |
| 81 | expansive top |
| 82 | work surface |
| 83 | circular plate |
| 84 | plate opening |
| 85 | set screw |
| 86 | electric motor |
| 87 | shaft |
| 88 | worm gear |
| 89 | pinion gear |
| 90 | motor drive |
| 91 | operating panel |
| 92 | arrow |
| 93 | arrow |
| 94 | key pad numeral |
| 95 | key pad numeral |
| 96 | key pad numeral |
| 97 | set key |
| 98 | digital readout |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. An elevating table apparatus comprising:

a) a table top providing an upper work surface and a lower surface;

b) a plurality of table legs, each leg including telescoping leg members, one telescoping leg member being a sleeve member that has a bore that is receptive of the other leg member;

c) a geared mechanism on the upper end portion of each leg that enables a user to elevate the table top relative to an underlying support surface or floor, the geared mechanism including multiple gears that rotate together;

d) each leg having a gear box housing that envelops the geared mechanism and that extends circumferentially around and radially away from the geared mechanism, wherein the housing is structurally connected to both the table top and each leg;

e) the gear box housing being connected to the leg below the geared mechanism;

f) the gear box housing having an upper peripheral edge portion that is structurally connected to the table top and that extends radially out from the geared mechanism, and wherein the gear box housing surrounds the geared mechanism; and g) wherein there are no connections below the gear box housing that span in a generally horizontal direction from one leg to another leg below said table top.

2. The elevating table apparatus of claim 1 wherein the geared mechanisms of the legs are manually movable using a crank.

3. The elevating table apparatus of claim 1 wherein at least one of the legs is supported by a lower foot that extends in front of and behind the leg.

4. The elevating table apparatus of claim 3 wherein the lower foot has a socket that is receptive of the lower end of a said leg.

5. The elevating table apparatus of claim 3 wherein each foot is rotatable upon a said leg so that feet on multiple legs can be oriented to form an acute angle.

6. The elevating table apparatus of claim 1 wherein one leg member is an inner member that moves up and down relative to the other leg member.

7. The elevating table apparatus of claim 6 wherein one leg member is an outer, stationary member.

8. The elevating table apparatus of claim 1 further comprising a caster fitted to the bottom of at least one of the legs.

9. The elevating table apparatus of claim 1 wherein the leg members are each generally cylindrically shaped.

10. An elevating table apparatus comprising:

a) a table top providing an upper work surface and a lower surface;

b) a plurality of table legs, each leg including telescoping leg members including an inner member and an outer sleeve member that has a bore that is receptive of the inner member, and wherein each leg has a minimum leg height and a maximum leg height;

c) a geared mechanism on each leg that enables a user to elevate the table top relative to an underlying support surface or floor;

d) a gear box housing that envelops that geared mechanism and that is structurally connected to both the table top and each leg;

e) the gear box housing being connected to the leg with a connection that extends below the geared mechanism and extending upwardly to engage the table top;

f) the gear box housing having an upper peripheral edge portion that is structurally connected to the table top and that extends radially out from the geared mechanism, and wherein the gear box housing surrounds the geared mechanism; and g) wherein there are no connections below the gear box housing that span in a generally horizontal direction from one leg to another leg below said table top.

11. The elevating table apparatus of claim 10 wherein the geared mechanism is movable using a crank.

12. The elevating table apparatus of claim 10 wherein at least one of the legs is supported by a lower foot that extends in front of and behind the leg.

13. The elevating table apparatus of claim 12 wherein each leg and foot are rotatable so that feet on multiple legs can be oriented to form an acute angle.

14. The elevating table apparatus of claim 10 wherein the inner member moves up and down relative to the outer sleeve member.

15. The elevating table apparatus of claim 10 further comprising a caster fitted to the bottom of at least one of the legs.

16. The elevating table apparatus of claim 10 wherein the lower foot has a socket that is receptive of the lower end of a said leg and the lower end of the outer sleeve member.

17. The elevating table apparatus of claim 10 wherein the inner member and outer sleeves are generally cylindrically shaped.

18. An elevating table apparatus comprising:

a) a table top providing an upper work surface and a lower surface;

b) a plurality of table legs, each leg including multiple leg members including an inner member and an outer member that has a bore that is receptive of the inner member;

c) a geared mechanism on each leg that enables a user to elevate the table top relative to an underlying support surface or floor, the geared mechanism including multiple gears that rotate together;

d) a gear box housing that envelops the geared mechanism and that is structurally connected to both the table top and each leg, said housing connecting to each leg at a position positioned below the geared mechanism;

e) the geared mechanisms being simultaneously rotated during elevation and wherein load transfer between the table top and legs is via a said gear box housing; and f) wherein there are no connections below the gear box housing that span in a generally horizontal direction from one leg to another leg below said table top.

19. An elevating table apparatus, comprising:

a) a table top providing an upper work surface and a lower surface;

b) a plurality of table legs, each leg including leg members including an inner leg moving member and an outer leg member that has a bore that is receptive of the inner leg member, one of said leg members being stationary and non-elevating;

c) a geared mechanism on the upper end portion of each leg that enables a user to elevate the table top relative to an underlying support surface or floor;

d) each said geared mechanism including multiple gears that rotate together;

e) each leg having a gear box housing that surrounds the geared mechanism and that extends circumferentially around and radially away from the geared mechanism, the housing being structurally connected to the table top at a first attachment area with a plurality of fasteners that extend through the housing into the table top;

f) the housing being connected to a said leg at a second attachment area smaller than the first attachment area and wherein the housing spans between the first and second attachment areas;

g) each gear box housing being connected to a leg below the geared mechanism, the gear box housing having an upper peripheral edge portion that is structurally connected to the table top, the peripheral portion extending radially beyond the diameter of the leg inner moving member, and the peripheral portion extending circumferentially around the geared mechanism;

h) an externally threaded rod having an upper rod end that is attached to and that rotates with one of the gears, the rod extending from the gear box to an internally threaded nut that is attached to said stationary non-elevating leg member;

i) wherein the rod engages the internally threaded nut so that the rotation of the rod effects an elevation of the table top; and j) wherein there are no connections below the gear box housing that span in a generally horizontal direction from one leg to another leg below said table top.

* * * * *